US007045563B2

(12) United States Patent
Luukkonen

(10) Patent No.: US 7,045,563 B2
(45) **Date of Patent: *May 16, 2006**

(54) ADDITIVE COMPOSITION FOR PAPER MAKING

(75) Inventor: Kari Luukkonen, Raisio (FI)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/407,947

(22) Filed: Apr. 7, 2003

(65) Prior Publication Data

US 2004/0144512 A1 Jul. 29, 2004

Related U.S. Application Data

(63) Continuation of application No. 09/756,758, filed on Jan. 10, 2001, now abandoned, which is a continuation-in-part of application No. PCT/FI99/00602, filed on Jul. 7, 1999.

(30) Foreign Application Priority Data

Jul. 10, 1998 (FI) ..... 981586
Feb. 5, 1999 (FI) ..... 990228

(51) Int. Cl.

| | |
|---|---|
| ***C08G 18/42*** | (2006.01) |
| ***C08H 89/00*** | (2006.01) |
| ***C08L 3/00*** | (2006.01) |
| ***C09B 67/00*** | (2006.01) |
| ***D21H 29/54*** | (2006.01) |
| *C08F 283/08* | (2006.01) |
| *C08L 73/00* | (2006.01) |

(52) U.S. Cl. ..... 524/47; 524/500; 524/502; 524/508

(58) Field of Classification Search ..... 524/47, 524/500, 502, 508

See application file for complete search history.

(56) References Cited

U.S. PATENT DOCUMENTS 6,398,912 B1 * 6/2002 Vihervaara et al. ..... 162/175
6,753,377 B1 6/2004 Niinikoski et al.

FOREIGN PATENT DOCUMENTS

FI 990229 2/1999
WO WO 00/46264 * 8/2000

* cited by examiner

*Primary Examiner*—Nathan M. Nutter
(74) *Attorney, Agent, or Firm*—Sheila A. Loggins

(57) ABSTRACT

The object of the present invention is an additive composition for paper making which is added to the pulp prior to web formation in order to increase the wet strength of the web. The basic component of the composition is a component made from starch, which to its molecular weight has been thinned to a viscosity level of 10 to 400 (5%, 60° C., Brookfield) which by solution cationizing using a quaternary nitrogen compound is cationized to a charge of <4 mEkv/g, the composition containing at least one additional component selected from 1) a starch-based polymer dispersion which contains starch and a monomeric graft copolymer, providing a polymer having a film formation temperature of −50 to 200° C., and
2) polyamide epichlorhydrin resin (PAAE).

15 Claims, 2 Drawing Sheets

Table 1

| Additive | Dose (kg/t) | Dry-matter content (%) | Strength of wet web N/m | Effect of additive, N/m |
|---|---|---|---|---|
| 15 | 1 | 31.6 | 65.73 | 1.83 |
| 15 | 2 | 30.4 | 57.51 | -1.18 |
| 15 | 3 | 33.8 | 72.81 | -0.64 |
| S | 1 | 33.6 | 78.14 | 5.55 |
| S | 2 | 29.9 | 64.27 | 7.75 |
| S | 3 | 29.6 | 65.08 | 9.86 |
| P | 1 | 28.2 | 59.22 | 10.08 |
| P | 2 | 30.0 | 75.82 | 18.86 |
| P | 3 | 29.3 | 66.79 | 12.87 |
| SP | 1 | 27.8 | 72.41 | 24.83 |
| SP | 2 | 25.0 | 62.11 | 27.04 |
| SP | 3 | 26.1 | 60.99 | 21.10 |

ADDITIVE COMPOSITION FOR PAPER MAKING

CROSS-REFERENCE TO RELATED APPLICATIONS

This is a Continuation application of Ser. No. 09/756,758 filed Jan. 10, 2001 now abandoned which was a continuation-in-part of PCT/F199/00602 filed Jul. 7, 1999 which designated the U.S.

The invention concerns an additive composition for paper making to be added to fiber pulp in a step preceding the web formation step of the paper making. The additive improves essentially the strength of the wet web, which is important as regards the wet part of the paper machine, because the improved strength diminishes breaks and makes the use of higher machine speeds possible.

Figure 1:
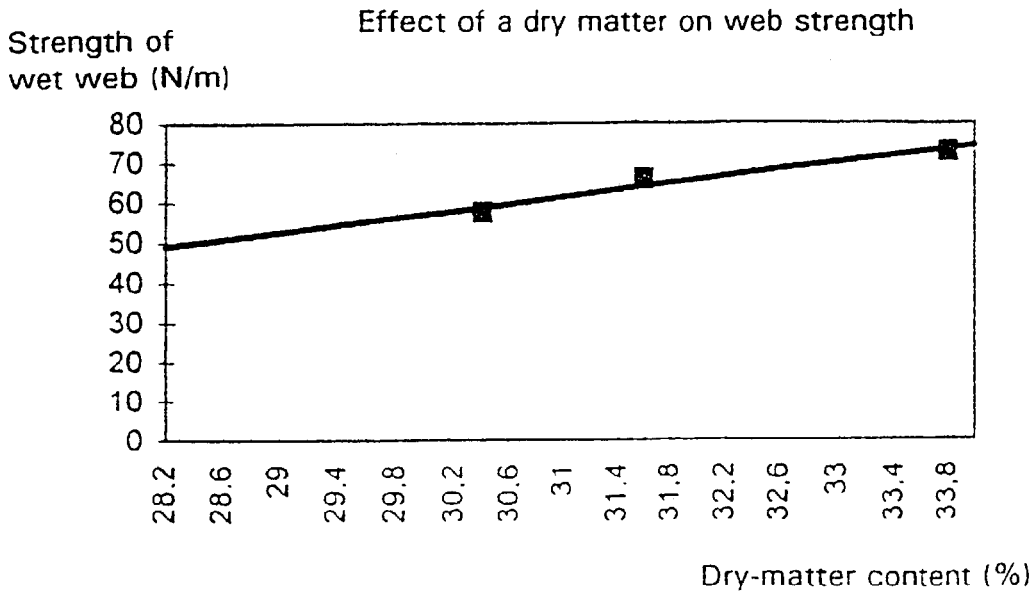
FIG. 1. shows the effect of percent dry-matter on web strength according to Example 1.
Figure 2:
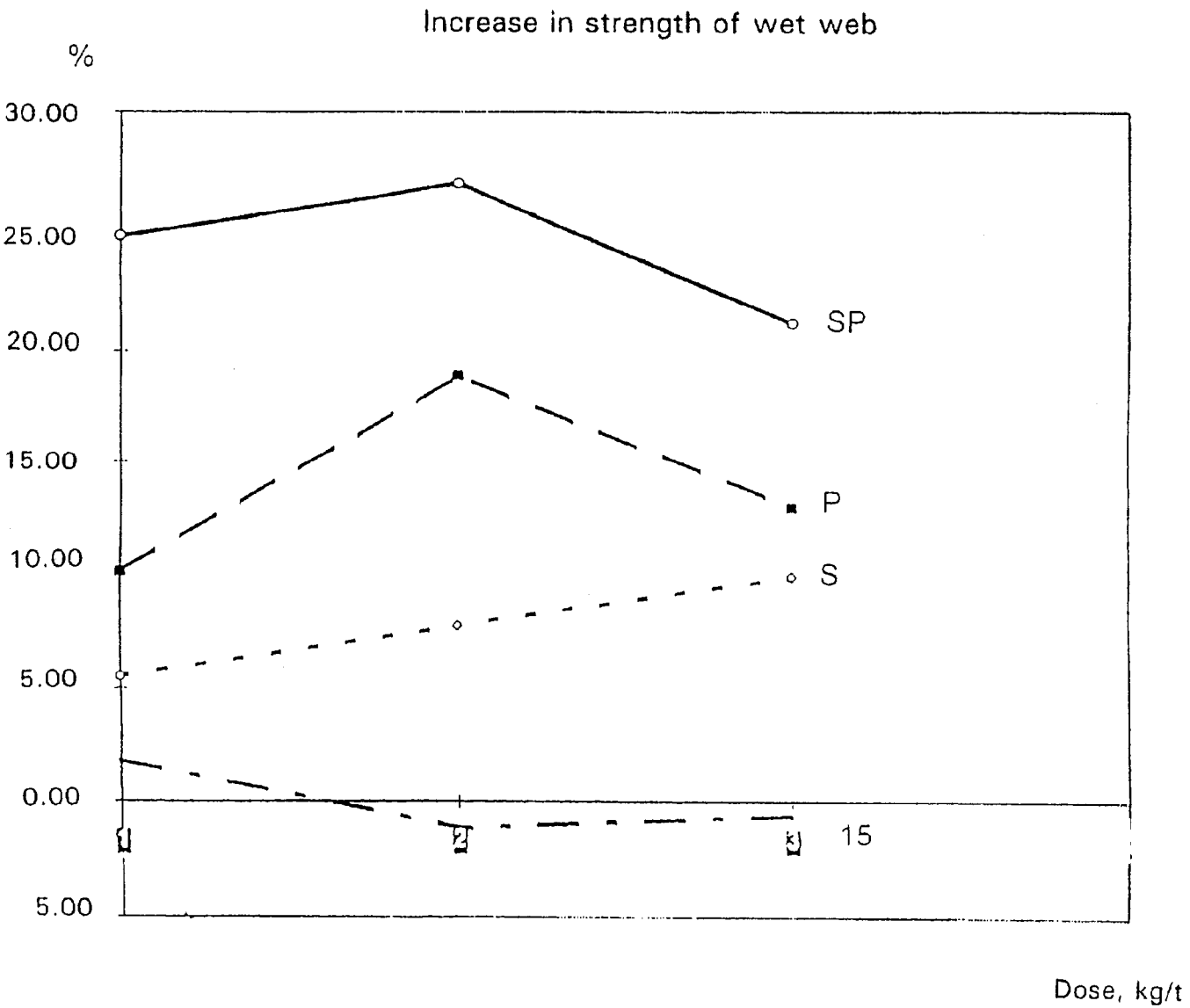
FIG. 2. shows the effect of dose in kilograms per ton on increase in strength of wet web according to Example 1.

The basic component in the additive composition is starch, which has been modified to better meet the requirements of the invention, by reduction of its molecule size and reacting the same with a suitable nitrogen compound in order to accomplish a proper cationic charge for the starch.

The reduction of the molecule size has been performed preferably using oxidation, such as peroxide oxidation. The reduction in molecule size is preferably effected so that a starch suspension with a consistency of 5% possesses a viscosity of 10 to 400 mPas (Brookfield), preferably 100 to 400 mPas, and most preferably 100 to 200 mPas at a temperature of 60° C. These values can be achieved for instance using a hydrogen peroxide amount of about 0.02 to 0.3% based on the dry-matter of the starch in mild alkaline reaction conditions. The degree of degradation aimed at depends also on the cationic charge of the end product, because an increase in the cationic charge has a lowering effect on the viscosity of the end product. A dependency prevails also between the molecule size and the cationic charge, which has an influence on the behaviour of starch on paper machine.

Starch, which is modified to a proper viscosity level is then processed with a quaternary nitrogen compound in conformity with the invention so, that it possesses a cationic charge in the range of <4, preferably 0.36 to 2.5, more preferably 0.72 to 1.10 mEq/g. The product is made preferably using a solution cationizing process where the starch is introduced into the cationizing process in granular form, and the process conditions are selected to solubilize the starch totally during the process. Essential parameters for the process in this respect are the percentage of the starch to be cationized, a suitable alkalinity, and an elevated temperature. A suitable alkaline (NaOH) charge is about 1.5–3% of the dry-matter of the starch, and a suitable temperature is about 60 to 80° C. The dry-matter content of the reation mixture should preferably be above 50%, which i.a. gives a good yield for the end product. A suitable quaternary cationizing chemical is 2,3-epoxypropyl-trimethylammonium chloride, which is to used in an amount of about 10 to 40% of the starch.

In addition to the basic component the additive composition contains at least one further component, by means of which the properties of the basic component, which are advantageous as such to the paper making process, can be modified in a direction towards the desired effect, and/or provide a composition, in which the synergistic effect of the components gives properties clearly different from the properties of the basic component.

One possible further component is a polymer dispersion based on starch, and containing a graft copolymer of starch and monomers, subsequently called the graft component. This component contains, calculated as dry weight of the product, the following a) 5 to 50% starch with a degree of substitution (DS), relative to the cationic or anionic substituents, of from 0.01 to 1, and an intrinsic viscosity of >1.0 dl/g, when cationized and/or anionized, b) 50 to 95% of a monomer mixture containing at least one vinyl monomer, providing a polymer having a film formation temperature of −50 to 200° C. preferably of 0 to 100° C., more preferably of 0 to 70° C., most preferably of 10 to 50° C., and c) water.

The preferred substitution of the starch graft component in the above further component a) is accomplished to provide a cationic substitution within the mentioned range.

The detailed composition of the said graft component and the preparation thereof is disclosed in publication WO 00/46264 based on Finnish patent application No 990229, and entitled "Polymer dispersion and method to produce the same".

Another alternative component for the additive composition is polyamide epichlorhydrin resin (PAAE) used as a wet strength resin in the paper industry, which in the following will be called the resin component.

The additive composition can be made from these components alternatively depending on the intended use, so that the either the graft or the resin component, or both, are added to the basic component.

The quantitative ratios between the basic component and the graft component can be chosen in the range of 30 to 70/70 to 30%, preferably 40 to 60/60 to 40%. A composition containing equal parts is especially preferred.

Correspondingly the quantitative ratios between the basic component and the resin component can vary in the ranges 25 to 75/75 to 25%, preferably 40 to 60/60 to 40%. Also in this case a composition containing equal parts is especially preferred.

In case the additive is composed of all three components, the proportions of the components can be within the ranges:

basic component, 10 to 50%, preferably 20 to 40% graft component 10 to 50%, preferably 20 to 40% resin component 10 to 50%, preferably 20 to 40% so that the composition forms 100%.

It has been observed that advantageous results can be obtained with the additive composition according to the invention for example so that the basic component together with the graft component has led to improved retention on the paper machine. It has been observed that the printing characteristics of a paper made using this additive compostion have improved, as also improved paper strength characteristics and improved dimensional stability have been observed.

The basic component and the resin component decrease the linting tendency of the manufactured paper. Improved retention and improved dewatering have been observed as advantageous effects in the manufacturing stage. It has also been observed that the additive has fixating properties, which is of importance from the point of view of removing detrimental substances from the circulation.

It has been observed that the strength of the wet stage web has increased especially with an additive composition which in addition to the basic component includes both a graft and a resin component.

The operability of the invention is illustrated with the following example.

EXAMPLE 1

Newsprint was made on a pilot scale paper machine, the fiber stock of which consisted of 50% pressure groundwood and 50% thermomechanical pulp, which had been bleached with dithionite. In the test run, additive composition in an amount of 1, 2 and 3 kg/ton paper (dry/dry) was added to the pulp prior to web formation.

The basic component in the additive composition used in the tests was thinned starch, which had been cationized using 25%, calculated from the amount of starch, of the cationizing chemical 2,3-epoxypropyl-trimethylammonium chloride.

As a second additional component, graft component, to be combined with this basic component a composition was used which contains 20% starch, having a cationic degree of substitution of approximately 0.05 and an intrinsic viscosity of 3 to 15 dl/g, 19% acrylonitrile, 30% butyl acrylate, 31% styrene, and water.

As a second additional component, the resin component, polyamide epichlorhydrin resin (PAAE) was used.

The test results obtained are given in the table I in appendix 1 hereto.

The reference in the test was an additive, which was the same as the basic component of the additive composition according to the invention, and is indicated in the table with the symbol "15".

The symbol "S" in the table means an additive composition containing 50% basic component 15 and 50% graft component. The symbol "P" in turn means an additive composition containing 50% of basic component and 50% of resin component. The symbol "SP" in turn means a composition containing ⅓ of basic component, ⅓ of graft component and ⅓ of resin component.

The strength of the wet web was measured and based thereon the effect of the additive component on the strength was derived, by taking into account the effect of the dry-matter content of the web on the strength of the web. The relationship between the dry matter content of the web and the strength is disclosed in the graph in connection with the table I.

Based on the test results it can be deduced that all the compositions S, P and SP increased the strength of the wet web, of these the composition SP the best.

The development of the strength of the wet web as obtained from the test results is also disclosed as a graph as according to appendix 2. The symbols 15, S, P and SP correspond to the compositions defined above.

What is claimed is:

1. An additive composition for paper making comprising as basic component, a starch which has had its molecular size reduced to provide a viscosity level of 10 to 400 mPas (5%, 60° C., Brookfield) and which has been cationized to a charge level of 0.36–2.5 mEq/g, as additional component, a polymer dispersion which has been prepared from components comprising:

(a) from 5 to 50% based upon the dry matter of said dispersion of starch with a degree of substitution (DS) of 0.01 to 1 relative to at least one member selected from the group consisting of cationic and anionic substituents and having an intrinsic viscosity of >1.0 dl/g, when substituted, (b) from 50 to 95% based upon the dry matter of said dispersion of a monomer mixture containing at least one vinyl monomer and providing a polymer having a film formation temperature of −50 to 200° C.;

and c) water.

2. The additive composition of claim 1, wherein said basic component has had its molecular weight reduced to provide a viscosity level of 100 to 400 mPas (5%, 60° C., Brookfield).

3. The additive composition of claim 1, wherein said basic component has had its molecular weight reduced to provide a viscosity level of 100 to 200 mPas (5% 60° C., Brookfield).

4. The additive composition of claim 1, wherein said basic component has been cationized by solution cationization using a quaternary nitrogen compound.

5. The additive composition of claim 1, wherein said basic component has been cationized to a charge level of 0.72 to 1.10 mEq/g.

6. The additive composition of claim 1, wherein said film formation temperature is known from 0 to 70° C.

7. The additive composition of claim 1 comprising, based upon the dry matter of said dispersion, from 30 to 70% said basic component and from 30 to 70% said additional component.

8. The additive composition of claim 1 comprising, based upon the dry matter of said dispersion from 40 to 60% said basic component and from 40 to 60% said additional component.

9. The additive composition of claim 1 comprising, based upon the dry matter of said dispersion, about equal amounts said basic component and additional component.

10. The additive composition of claim 1 further comprising a resin component.

11. The additive composition of claim 10, wherein said resin component comprises polyamide epichlorydrin resin.

12. The additive composition of claim 10 comprising, based upon the dry matter of said dispersion, from 10 to 50% said basic component, from 10 to 50% said additional component and from 10 to 50% said resin component.

13. The additive composition of claim 10 comprising, based upon the dry matter of said dispersion, from 20 to 40% said basic component, from 20 to 40% said additional component and from 20 to 40% said resin component.

14. A method for increasing the strength of a wet paper web, wherein an additive composition of claim 1 is added to a fiber suspension before the web formation.

15. The method of claim 14, wherein the additive composition is added from 1.0 to 3.0 kg per dry fiber ton.

* * * * *